US012570446B2

(12) United States Patent
Ramsuer et al.

(10) Patent No.: US 12,570,446 B2
(45) Date of Patent: Mar. 10, 2026

(54) AEROSOL CAPS AND METHODS OF USING THE SAME

(71) Applicant: SILGAN DISPENSING SYSTEMS CORPORATION, Richmond, VA (US)

(72) Inventors: Brandon Ramsuer, Henrico, VA (US); Connie Tran, Richmond, VA (US); Graham Wilson, Richmond, VA (US)

(73) Assignee: SILGAN DISPENSING SYSTEMS CORPORATION, Richmond, VA (US)

( * ) Notice: Subject to any disclaimer, the term of this patent is extended or adjusted under 35 U.S.C. 154(b) by 263 days.

(21) Appl. No.: 18/213,937

(22) Filed: Jun. 26, 2023

(65) Prior Publication Data

US 2024/0425248 A1 Dec. 26, 2024

(51) Int. Cl.
*B65D 50/04* (2006.01)

(52) U.S. Cl.
CPC ..... *B65D 50/046* (2013.01)

(58) Field of Classification Search
CPC .... B65D 83/40; B65D 83/14; B65D 83/1414; B65D 83/145; B65D 83/16; B65D 83/75; B65D 83/206; B65D 83/20; B65D 83/204
USPC ..... 222/182, 153.13, 402.13, 402.11; 215/201, 204, 250, 281
See application file for complete search history.

(56) References Cited

U.S. PATENT DOCUMENTS 2,887,273 A * 5/1959 Anderson ..... B65D 83/206 222/402.11
3,269,614 A * 8/1966 Abplanalp ..... B65D 83/20 222/509
3,409,186 A * 11/1968 Melocchi ..... B65D 83/40 251/342
3,510,029 A * 5/1970 Doyle ..... B65D 83/206 222/402.12
3,532,249 A * 10/1970 Gach ..... B65D 83/40 220/915
3,544,023 A * 12/1970 Hendrickson ..... B65D 83/40 220/270
3,565,295 A * 2/1971 Doyle ..... B65D 83/40 220/915
3,729,119 A * 4/1973 Sette ..... B65D 83/24 222/402.11
3,729,120 A * 4/1973 Sette ..... B65D 83/24 222/402.11
3,802,607 A * 4/1974 Mead ..... B65D 50/045 222/182
3,854,622 A * 12/1974 McKirnan ..... B65D 83/40 220/915
3,866,802 A * 2/1975 Birrell ..... B65D 41/06 222/153.1
3,934,751 A * 1/1976 Green ..... B65D 83/40 220/915

(Continued)

*Primary Examiner* — Steven A. Reynolds
*Assistant Examiner* — Prince Pal
(74) *Attorney, Agent, or Firm* — Hinckley Allen & Snyder; Stephen Holmes

(57) ABSTRACT

An aerosol cap having tamper evident features that may be used to assist with the removal of the aerosol cap from an aerosol product includes one or more release tabs which may be forced inward of an outer shell of the aerosol cap to engage an interior shell to disengage the aerosol cap from an aerosol product, the movement of the release tabs visually evidencing tampering with, or removal of, the aerosol cap from the aerosol product.

11 Claims, 10 Drawing Sheets

(56) References Cited

U.S. PATENT DOCUMENTS 3,940,024 A * 2/1976 Russo ..... B65D 83/20 222/182
3,964,634 A * 6/1976 Jasinski ..... B65D 83/40 222/153.1
3,995,765 A * 12/1976 Burke ..... B65D 83/40 215/208
4,149,646 A * 4/1979 Julian ..... B65D 50/046 215/216
4,277,004 A * 7/1981 Barlics ..... B65D 83/20 222/330
4,333,589 A * 6/1982 Bush ..... B65D 83/206 222/402.11
D316,675 S * 5/1991 Cramer ..... D9/448
5,105,988 A * 4/1992 Knickerbocker ... B05B 11/1052 239/115
5,649,645 A * 7/1997 Demarest ..... B65D 83/20 222/153.07
5,722,546 A * 3/1998 Briere ..... B65D 50/046 215/221
5,850,951 A * 12/1998 Hayes ..... B65D 43/0256 222/525
5,918,752 A * 7/1999 Meyer ..... B65D 50/041 215/253
6,112,933 A * 9/2000 Meyer ..... B65D 83/40 220/915
6,161,736 A * 12/2000 Kaufman ..... B65D 83/206 222/402.15
6,695,171 B2 * 2/2004 Walters ..... B05B 11/1059 222/321.9
6,908,017 B2 * 6/2005 Mineau ..... B65D 83/20 222/402.1
7,530,470 B1 * 5/2009 Houser ..... B65D 50/046 220/915
7,588,171 B2 * 9/2009 Reedy ..... B65D 83/20 222/402.11
7,757,905 B2 * 7/2010 Strand ..... B65D 83/206 222/404
8,292,101 B1 * 10/2012 Bragg ..... B65D 47/0838 220/254.5
8,544,664 B2 * 10/2013 Dejonge ..... B05B 11/0038 220/254.1
8,875,951 B2 * 11/2014 Houser ..... B65D 83/206 222/402.11
9,260,236 B2 * 2/2016 Schumacher ..... B65D 83/40
9,387,976 B2 * 7/2016 Geis ..... B65D 83/384
9,511,925 B2 * 12/2016 Edenilson ..... B05B 11/1059
9,738,436 B2 * 8/2017 Sell ..... B65D 83/22
9,944,454 B2 * 4/2018 Haage ..... B65D 47/261
11,440,708 B2 * 9/2022 Simonds ..... B65D 50/041
11,440,726 B1 * 9/2022 Beegle ..... B65D 83/22
11,618,619 B2 * 4/2023 Biesecker, II ..... B65D 51/245 215/219
2003/0038146 A1 * 2/2003 Meshberg ..... B05B 11/1059 222/321.9
2004/0084454 A1 * 5/2004 Tumlin ..... B65D 83/40 220/915
2004/0149756 A1 * 8/2004 Kaufman ..... B65D 83/40 220/915
2004/0245294 A1 * 12/2004 Mineau ..... B65D 83/345 222/402.13
2006/0219265 A1 * 10/2006 Shieh ..... E03C 1/304 134/22.12
2008/0061087 A1 * 3/2008 Reedy ..... B65D 83/20 222/402.15
2008/0067182 A1 * 3/2008 Underwood ..... B65D 83/40 220/784
2008/0164285 A1 * 7/2008 Hygema ..... B65D 83/206 222/402.11
2012/0187070 A1 * 7/2012 Dejonge ..... B05B 11/0027 215/219
2012/0187151 A1 * 7/2012 DeJonge ..... B65D 83/20 222/153.13
2013/0075429 A1 * 3/2013 Houser ..... B65D 83/22 222/402.11
2014/0361049 A1 * 12/2014 Arora ..... B65D 83/141 222/402.11
2020/0399050 A1 * 12/2020 Avedisian ..... B65D 83/20
2021/0053729 A1 * 2/2021 Benoit-Gonin ..... B65D 83/20
2024/0425248 A1 * 12/2024 Ramsuer ..... B65D 50/046
2025/0026558 A1 * 1/2025 Van Wieringen .... B65D 83/303
2025/0058959 A1 * 2/2025 Breidenbach ..... B65D 83/18
2025/0108961 A1 * 4/2025 Morrison ..... B65D 83/145

* cited by examiner

AEROSOL CAPS AND METHODS OF USING THE SAME

BACKGROUND OF THE INVENTION

Field of the Invention

Embodiments of the invention include aerosol can caps or covers that may be used with various aerosol dispensing systems and methods of using the aerosol caps.

Description of Related Art

Aerosol dispensers are well known and are commonly used for a variety of different applications. For example, aerosol dispensers are used in spray paint applications, where the typical spray paint aerosol dispenser includes a can or container holding the paint product and a propellant, an aerosol valve attached to the can or container, and an aerosol actuator in the form of a press-button or other dispensing system which can be actuated to dispense the paint from the can or container. Many such aerosol spray paint systems also include a cap or cover seated over the aerosol dispenser and attached to the can or container, a portion of the valve or valve cup, or the aerosol dispenser itself. Such caps or covers may help prevent inadvertent actuation of the aerosol dispenser, facilitate shipping of the aerosol products, help prevent use of the products by children, or be included for aesthetic reasons.

Like spray paint aerosol systems, many other aerosol dispensers or products employ or use caps or covers to prevent the inadvertent actuation of the aerosol dispenser, to provide support for distribution packaging, or to prevent access by children. For example, aerosol dispensers used in the beauty or hair care markets often include caps or covers. Likewise, aerosol dispensers used in air-care or other fields may also employ the use of a cap or cover.

At times, it may be beneficial for an aerosol cap or cover to be difficult to remove. For instance, aerosol caps have been developed such that a squeeze-and-pull action is required to remove the cap or cover, making it difficult for younger children to access an aerosol dispenser on a product not intended for child use. U.S. Pat. No. 7,530,470 describes an example of such aerosol caps or covers. These aerosol caps have been widely adopted in certain industries and especially in the aerosol paint industry as a standard cap for aerosol paint applications.

While caps or covers configured as described in U.S. Pat. No. 7,530,470 require additional dexterity to remove such cap to access the aerosol dispenser, such caps can be easily replaced or reattached to the can without disclosing the fact that the product has been used. Thus, while the caps commonly used on the market may deter inadvertent access to an aerosol dispenser, they do not show when—or if—an aerosol product has been tampered with.

Thus, tamper evidence features incorporated with an aerosol cap or cover for an aerosol dispensing device may be advantageous. This is especially true in the field of aerosol spray paint products. As many consumers are aware, aerosol spray paint products are commonly placed on a shelf and are accessible to the consumers. While the inclusion of a cap or cover having child-resistant features—or opening requirements-deters some opening and use at the point-of-retail sale, many stores experience "testing" or use by consumers at the point-of-retail sale. The fact that the existing caps or covers may be removed and reassembled onto the product without indicating that the product has been used, is also disadvantageous. For instance, in some stores, consumers will remove a cap, test the product on a piece of paper, the floor, or other surface near the product display, and then put the product back on the shelf if it does not meet their requirements or is not the color or sheen that they desire. The fact that they are able to perform such test and replace the product without anyone knowing that use occurred does not preclude such behavior. This results in a "used" product being restocked. Removal of the "test" product from store surfaces, or the restocking of new products, can result in lost revenue for the store selling such products.

In addition, testing and in-store use has the potential to create fire hazards and other safety concerns in stores. Because many of the products dispersed by aerosol paint systems are flammable, the spraying of paint—or testing of the aerosol paint products—in store creates a fire hazard or exposure hazard that may be in violation of local laws. To avoid such violation, and possible fines, stores are beginning to limit access to spray paint products by locking them up and requiring a store employee to assist with access to the products. This results in increased costs as the store must spend additional money in labor and storage and display fees.

It is therefore desirable to have an improved aerosol cap or cover system that can deter use in store. It would also be beneficial to have an aerosol cap or cover that would include a tamper evident feature that would allow a user, or a store owner, to visibly determine when a product on the store shelf had been tampered with or used.

BRIEF SUMMARY OF THE INVENTION

According to certain embodiments of the invention, an aerosol product may include an aerosol can or container equipped with an aerosol valve and an aerosol actuator or dispensing feature and an aerosol cap attached to the aerosol can or container. The aerosol cap encompasses or encloses the aerosol valve and aerosol actuator and may be used to show tampering with, or the use or attempted use of, the aerosol product.

According to certain embodiments of the invention, an aerosol cap includes a top deck, an outer edge, and an outer shell extending off the outer edge and away from the top deck. The outer shell may include one or more openings. One or more release tabs may be formed in the outer shell and may be positioned in the one or more openings. One or more frangible connections may retain a portion of the release tab in the one or more openings. The aerosol cap may also include an inner shell extending from the top deck into an interior space defined by the outer shell and the top deck. The inner shell may include one or more connection ribs configured to attach to a component of an aerosol product, such as the aerosol container, the aerosol valve, the dispensing feature of the aerosol product, a chime of the aerosol product or some other feature thereof.

In some embodiments of the invention, the one or more release tabs may be fixed to the outer shell of the aerosol cap such that movement of a release tab will indicate tampering with, or attempted removal of, the aerosol cap from the aerosol product. For example, a release tab may be further secured in the opening of the outer shell by the one or more frangible connections. Application of a force on the release tab may break the one or more frangible connections, allowing a portion of the release tab to be pushed inward towards the interior of the aerosol cap. The breaking of the one or more frangible connections evidences the tampering with, or the attempted removal of, the aerosol cap.

In other embodiments of the invention, discoloration of the material at a living hinge portion of a release tab may indicate use. In some embodiments, a release tab is connected to the outer shell, the outer edge, or the top deck of the aerosol cap by a living hinge. Application of a force on such release tab moves the tab inward of the outer shell with rotation occurring about the living hinge. The movement of the release tab at the living hinge may stress the material from which the aerosol cap is made, creating a different color at the living hinge, and showing tampering with the release tab.

In other embodiments, a release tab-once pushed towards an interior of the aerosol cap—may be retained in a position at least partially interior of the outer shell, creating a wider or larger opening in the outer shell which evidences the fact that the release tabs have been used or tampered with. For instance, in some embodiments of the invention, a release tab may include interior tab surface having a tab lock extending away from the interior tab surface. The inner shell may have a corresponding tab connection key extending from an outer surface of the inner shell. The tab lock may fit with or mate to the tab connection key when the release tab is moved sufficiently inward of the outer shell such that the tab connection key snaps together with the tab lock. Once connected, the interaction of the tab lock and tab connection key retains at least a portion of the release tab in an interior space of the aerosol cap.

In other embodiments, a release tab may include a tab clip connection portion and the inner shell may have a tab clip extending off an exterior surface of the inner shell. When a portion of the release tab adjacent the tab clip connection is pushed inward towards the interior of the aerosol cap, the release tab may engage the tab clip, causing it to flex to a point that the tab clip connection moves over the tab clip, allowing the tab clip to retain the release tab in such position. For example, a tab clip may include a sloping surface that is engaged by a portion of the release tab. As the engagement occurs, the tab clip is flexed away from the release tab until the release tab passes over the sloped surface at which point the tab clip springs back into position. A groove in the tab clip or a flange on the tab clip then engages with the release tab and the tab clip connection portion to retain the release tab in the pushed—in position.

According to various embodiments of the invention, actuation or movement of the one or more release tabs is required to remove an aerosol cap from the aerosol product. In various embodiments of the invention, the release tab must interact with the inner shell of the aerosol cap in order to deform the inner shell—or cause it to flex—such that any connection ribs connecting the aerosol cap to the aerosol product can be released to allow removal of the aerosol cap from the aerosol product. In some embodiments, the inner shell may include one or more protuberances extending away from the inner shell that interact with the release tabs to deform the inner shell. In other embodiments, the inner shell may include a tab connection rib or other rib extending from the outer surface of the inner shell, or from a protuberance, that interacts with a portion of a release tab to create sufficient force to deform the inner shell and release an aerosol cap from the aerosol product. In still other embodiments of the invention, the interaction of a tab connection key with a tab lock creates a connection through which force may be applied to the release tabs and carried to the inner shell in a sufficient amount to deform the inner shell and release the aerosol cap from the aerosol product.

According to various embodiments of the invention, once a release tab has been moved relative to the outer shell of the aerosol cap, the movement of the release tab is visually evident to a user. This evidence provides visual notification that the aerosol product may have been used or may have been tampered with. In some instances, the release tab is also secured to the inner shell through the combination of a tab lock and tab key connection or a tab clip connection and a tab clip, providing further evidence that the aerosol cap may have been tampered with or removed from the aerosol product.

According to various embodiments of the invention, an aerosol cap may be molded in a conventional manner. An aerosol cap may be made of known materials, including plastics, resins, recycled plastics, and other materials. In some embodiments, where an internal tab clip is formed with a portion of the inner shell or extending from the inner shell, one or more molding openings may be included in the top deck, outer edge, or outer shell to allow molding components to penetrate an interior of the aerosol cap during the molding process to assist with the formation of the tab clip.

BRIEF DESCRIPTION OF THE SEVERAL VIEWS OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
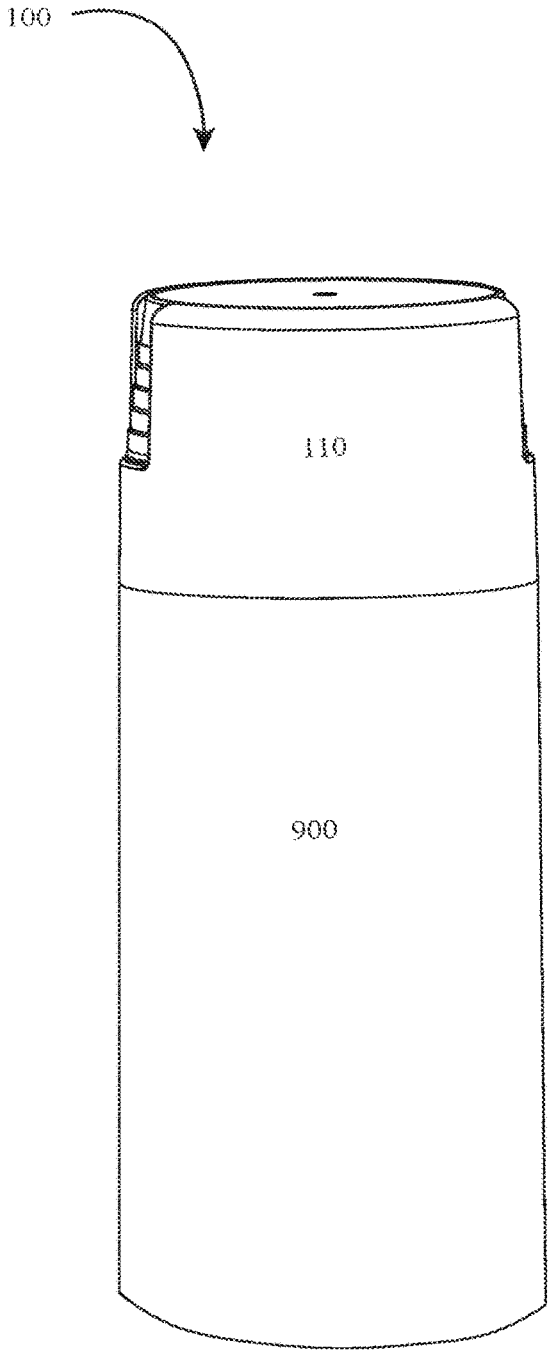
FIG. 1 illustrates an aerosol product having an aerosol cap according to various embodiments of the invention.

According to embodiments of the invention, an aerosol product 100 includes an aerosol container 900, an aerosol valve 910 attached to the aerosol container 900, a dispensing feature 950, and an aerosol cap 110. The aerosol cap 110 may be detachably connected to the aerosol container 900, the aerosol valve 910, the dispensing feature 950, or any combination thereof. An aerosol product 100 in an assembled state with the aerosol cap 110 attached to the remainder of the aerosol product 100 is illustrated in FIG. 1. The same aerosol product 100 with the aerosol cap 110 detached from the remainder of the aerosol product 100 is illustrated in FIG. 2.

Figure 2:
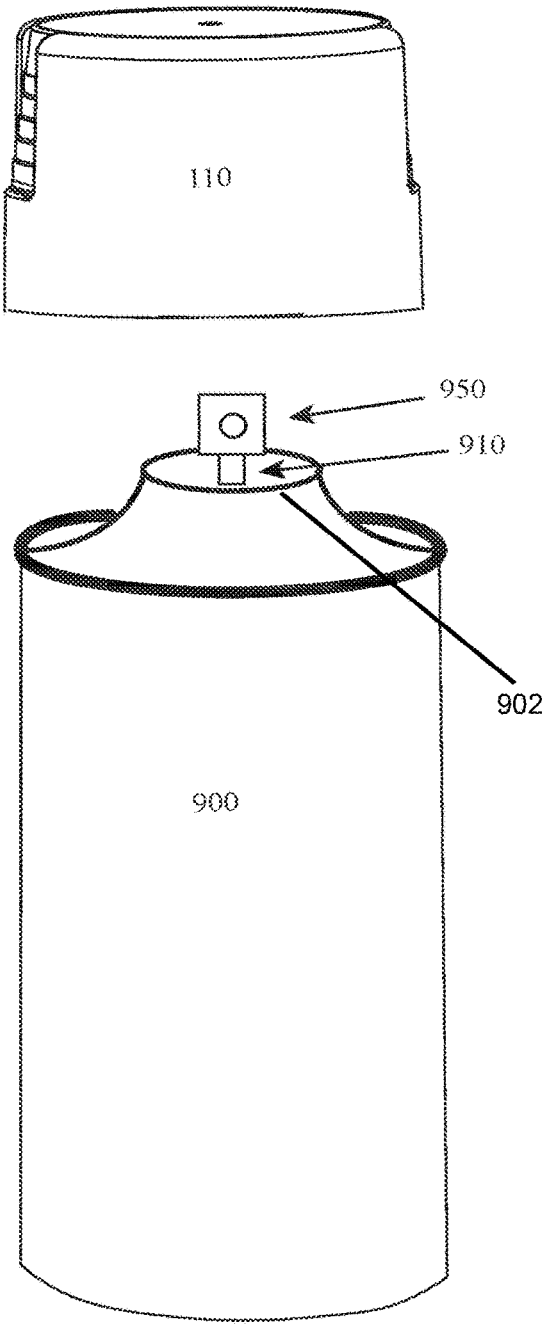
FIG. 2 illustrates the aerosol product of FIG. 1 with the aerosol cap removed from the other components.

FIG. 2 illustrates a conventional aerosol product 100 having an aerosol container 900, an aerosol valve 910, and a dispensing feature 950 in the form of a conventional pushbutton attached to the aerosol valve 910. An aerosol cap 110 according to various embodiments of the invention may be utilized with such aerosol products 100 or systems. In addition, aerosol caps 110 according to embodiments of the invention are not limited by the components of the aerosol product 100 to which they are being connected. An aerosol cap 110 may be combined with differently shaped aerosol containers 900 and may be configured to attach thereto. Similarly, aerosol caps 110 according to some embodiments of the invention may be configured to attached to a chime 902, a portion of an aerosol valve 910, the connection between the aerosol valve 910 and the aerosol container 900, or the dispensing feature 950 used to dispense product from the aerosol product 100. Conventional aerosol valves 910, dispensing features 950, and aerosol containers 900 may be used with embodiments of the invention.

Aerosol caps 110 according to various embodiments of the invention may include a top deck 114 or surface having an outer edge 115 and an outer shell 160 extending away from the top deck 114. The outer shell 160 may extend off the outer edge 115 of the top deck 114 or off a surface of the top deck 114 interior to the outer edge 115 of the top deck 114. One or more openings 164 may be present in the outer shell 160 or in the outer shell 160 and the top deck 114. One or more release tabs 200 may be seated or positioned in the one or more openings 164 and may be connected to the top deck 114, the outer shell 160, or both the top deck 114 and outer shell 160. A release tab 200 may be recessed in an opening 164 relative to the outer shell 160 or it may protrude out or away from an outer surface 164 of the outer shell 160.

For example, an aerosol cap 110 according to various embodiments of the invention is illustrated in FIGS. 3 through 7. As illustrated, an aerosol cap 110 includes a top deck 114 having an outer edge 115. An outer shell 160 extends off—or away from—portions of the outer edge 115 of the top deck 114. An opening 164 in the outer shell 160 extends from the outer edge 115 of the top deck 114 through a portion of the outer shell 160. A release tab 200 is attached to the outer edge 115 of the top deck 114 and extends into the opening 164. In some embodiments, the release tab 200 may be integrally formed with the top deck 114 and outer edge 115. The point of attachment of the release tab 200 to the top deck 114 at the outer edge 115—or the transition from the top deck 114 to the release tab 200 adjacent the outer edge 115—creates a hinge, such as the living hinge 206 illustrated in FIG. 3, about which the release tab 200 may rotate or move. One or more frangible connections 208 extend between the release tab 200 and the outer shell 160. The one or more frangible connections 208 may retain the release tab 200 in a position in the opening 164 of the aerosol cap 110. Once the one or more frangible connections 208 are broken, the release tab 200 may rotate or move relative to the living hinge 206.

Figure 3:
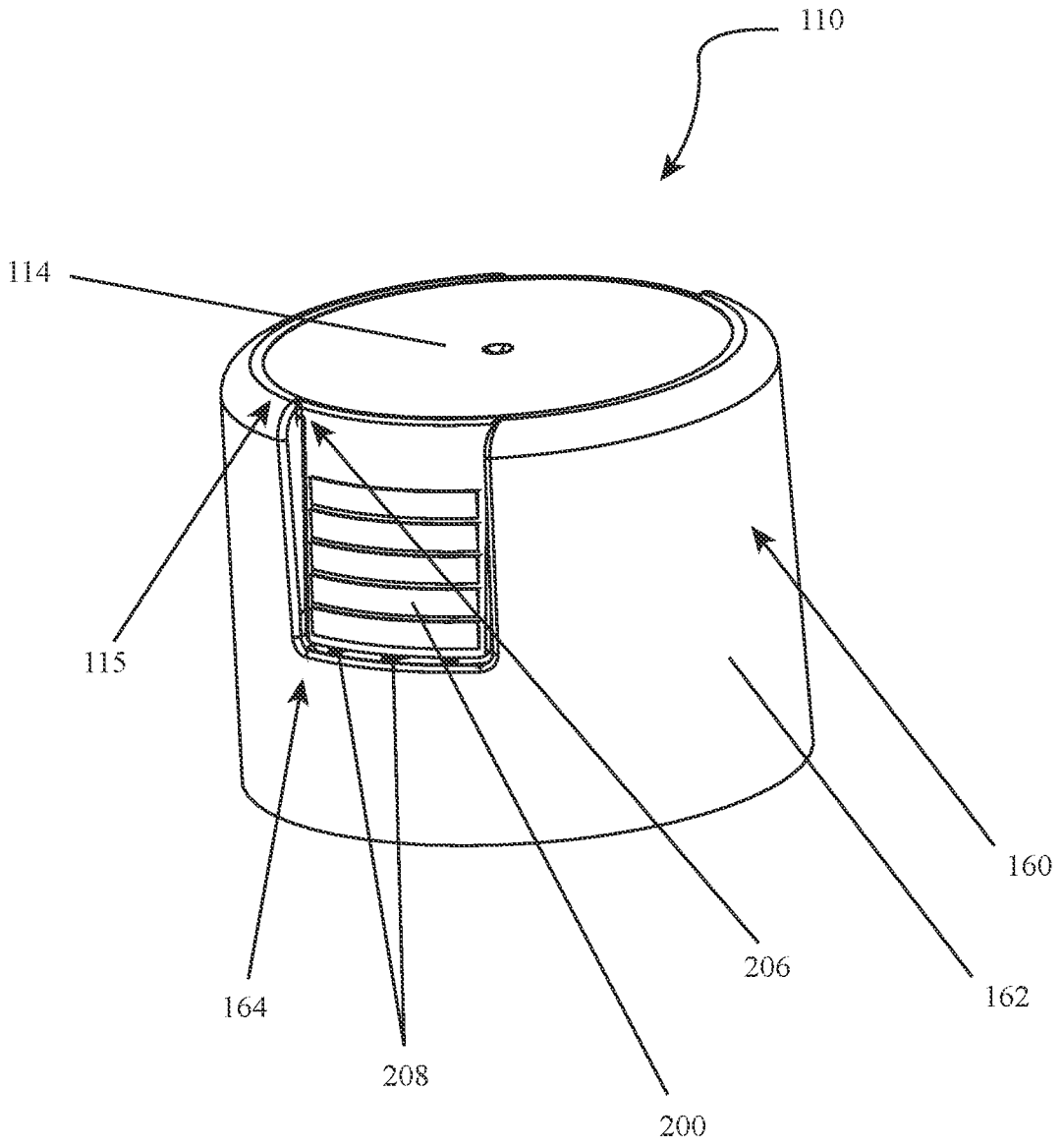
FIG. 3 illustrates a perspective view of the outside of an aerosol cap according to various embodiments of the invention.

In some embodiments of the invention, a release tab 200 may be fully recessed, or partially recessed, into an interior portion of the aerosol cap 110 or at least recessed with respect to a portion of an outer surface 162 of the outer shell 160. The release tab 200 illustrated in FIG. 3 is at least partially recessed in such a manner. In other embodiments of the invention, a release tab 200 may protrude fully or at least partially outward, or outside, of the outer surface 164 of the outer shell 160.

According to certain embodiments of the invention, an aerosol cap 110 may be molded as a unitary piece such that the top deck 114, outer shell 160 and one or more release tabs 200 are formed together-along with the other parts of the aerosol cap 110—in a single molding process. When so molded, release tabs 200 are connected to the top deck 114 or an upper portion of the outer shell 160 and are positioned within an opening 164 in the outer shell 160. The one or more frangible connections 208 are molded with each release tab 200 such that a release tab 200 may be held in position relative to the outer shell 160. Once the one or more frangible connections 208 are broken—for example, by a user squeezing or pushing a release tab 200 inward towards the center of the aerosol cap 110—or separated from a release tab 200, a portion of the release tab 200 may be pushed into an interior of the aerosol cap 110. A release tab 200, once freed of connection to the one or more frangible connections 208, may rotate about the living hinge 206 as it is pushed inward towards an interior of the aerosol cap 110.

Figure 4:
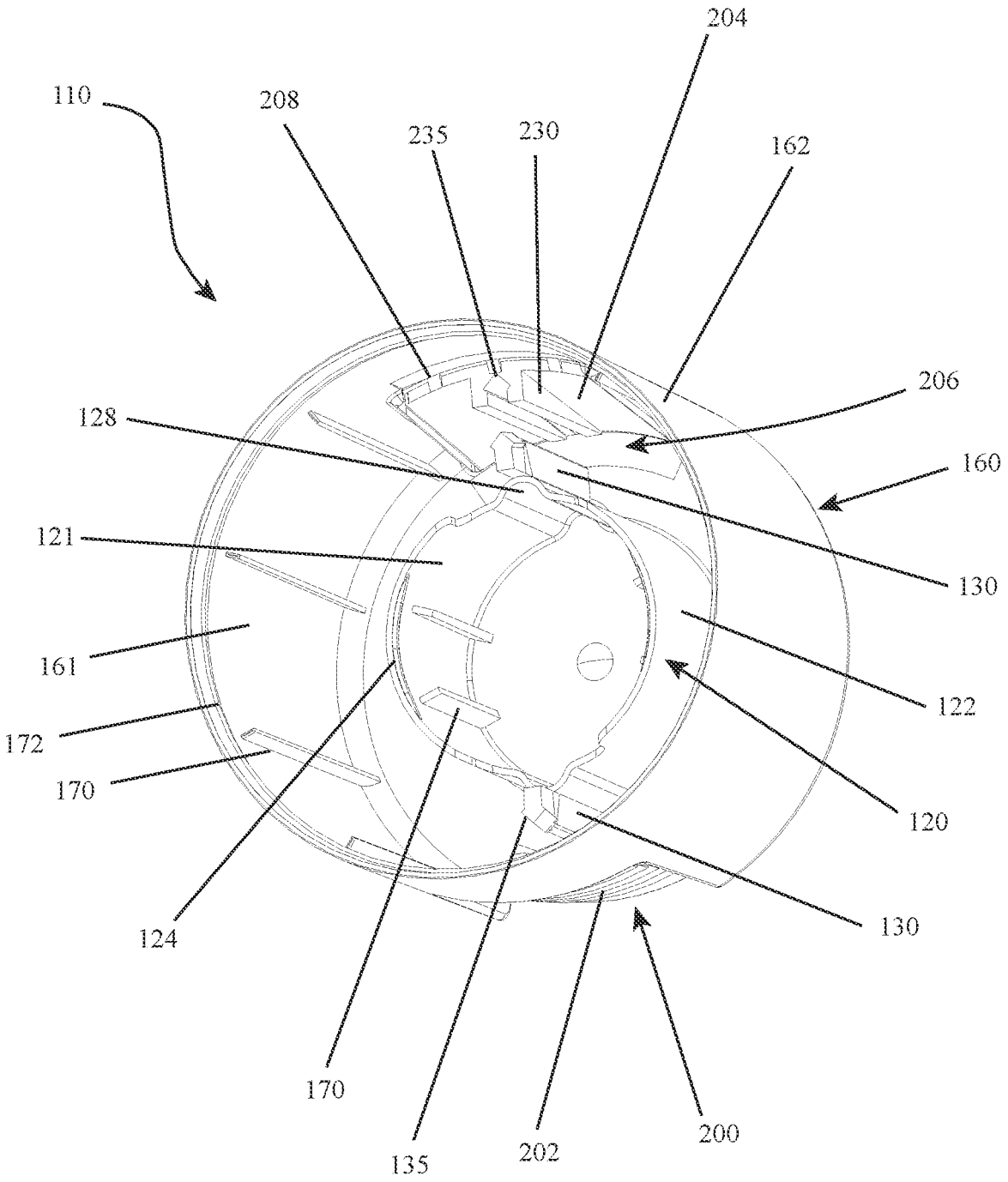
FIG. 4 illustrates a perspective view of an interior of an aerosol cap according to various embodiments of the invention.
Figure 5:
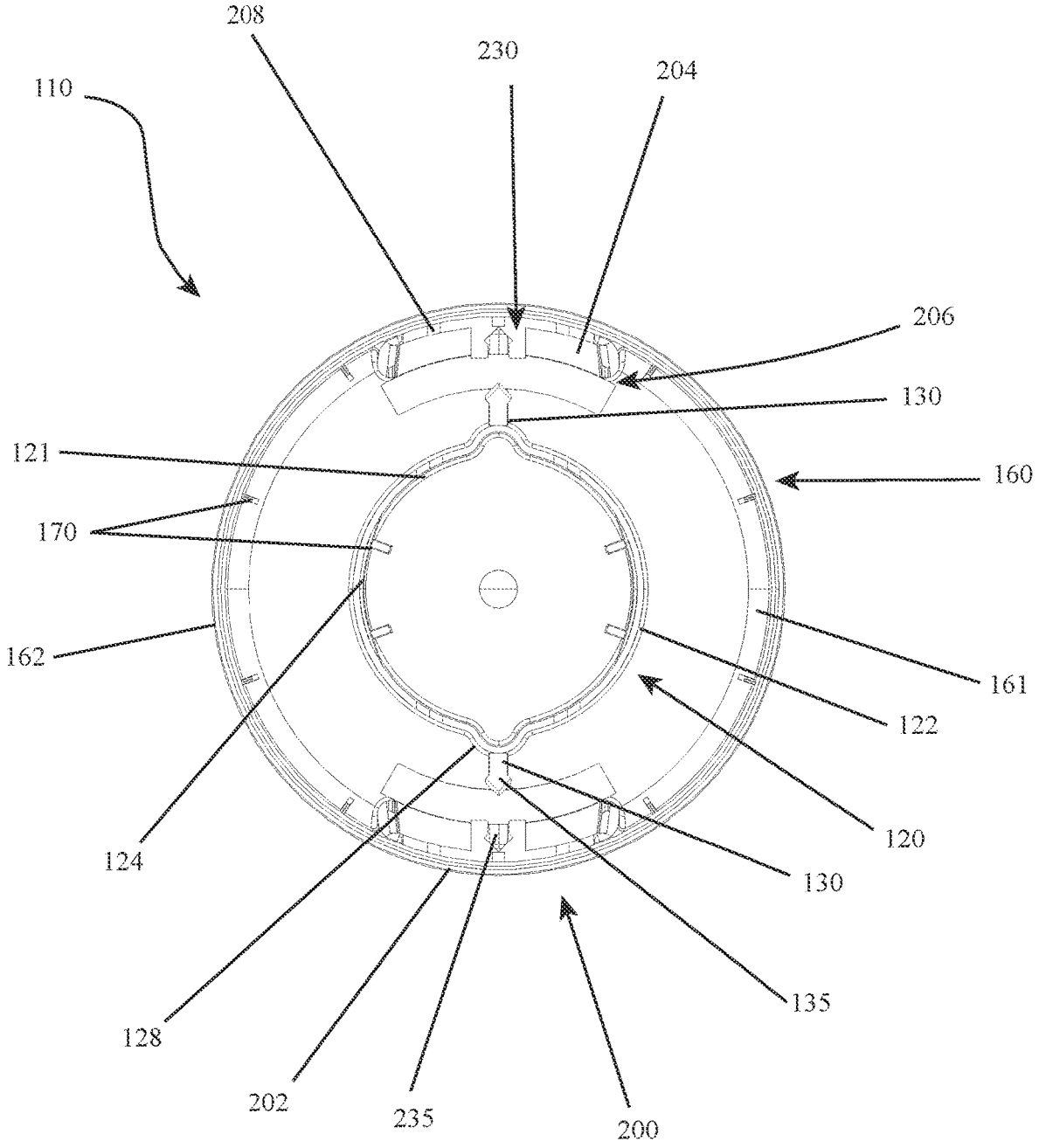
FIG. 5 illustrates a bottom view of the interior of an aerosol cap according to various embodiments of the invention.

Interior views of the aerosol cap 110 illustrated in FIG. 3 are illustrated in FIGS. 4 and 5. A bottom perspective view of the aerosol cap 110 is illustrated in FIG. 4 and a bottom view of the same aerosol cap 110 is illustrated in FIG. 5.

As illustrated in FIGS. 4 and 5, an outer shell 160 of the aerosol cap 110 includes an outer surface 162 and an inner surface 161. The outer shell 160 extends away from the top deck 114. Release tabs 200 are positioned in the two openings 164 in the outer shell 160 and one or more frangible connections 208 retain the release tabs 200 in their position in the openings 164. Where the release tabs 200 connect to or join with the top deck 114, there is a living hinge 206. Each of the two release tabs 200 include an exterior tab surface 202 and an interior tab surface 204.

One or more support ribs 170 may be formed or included on a portion of the inner surface 161 of the outer shell 160. The one or more support ribs 170 may extend from the top deck 114 or the outer edge 115 of the top deck 114 downwards along the inner surface 161 of the outer shell 160. The one or more support ribs 170 may provide structural support or stiffening to the outer shell 160, helping to maintain the shape and integrity of the outer shell 160 during use. In addition, the one or more support ribs 170 may terminate at a location that corresponds to a desired mating point with an aerosol container 900. For example, the aerosol cap 110 may be snapped onto an aerosol container 900 as illustrated in FIG. 1 and the one or more support ribs 170 may sit against a rim of the aerosol container 900 illustrated in FIG. 2. One or more connection lips 172 may also be included on an inner surface 161 of the outer shell 160. The one or more connection lips 172 may snap about a rim or snap feature included on an aerosol container 900. The one or more connection lips 172 and one or more support ribs 170 may work together to help connect an aerosol cap 110 to an aerosol container 900.

As illustrated in FIGS. 4 and 5, an aerosol cap 110 according to various embodiments of the invention also includes an inner shell 120. Inner shell 120 may extend from the top deck 114 into an interior space of the aerosol cap 110 as illustrated. The inner shell 120 includes an inner shell inner surface 121 and an inner shell outer surface 122. One or more connection ribs 124 may be formed or connected a portion of the inner shell inner surface 121. The one or more connection ribs 124 may be configured to snap to or connect with an aerosol product 100, such as to the chime, to a portion of the aerosol container 900, to an aerosol valve 910 feature, or to the dispensing feature 950 of the aerosol product 100. One or more support ribs 170 may also extend along a portion of the inner shell inner surface 121. The one or more support ribs 170 may provide structural support to the inner shell 120. In addition, the one or more support ribs 170 may be configured to work with the one or more connection ribs 124 to help retain the aerosol cap 110 on an aerosol product 100 when the aerosol cap 110 is snapped to the chime of an aerosol product 100, another portion of the aerosol container 900, an aerosol valve 910 feature, or the dispensing feature 950 of the aerosol product 100.

One or more tab connection ribs 130 may extend from the inner shell 120 and project outwardly from the inner shell outer surface 122 towards the outer shell 160 or the one or more release tabs 200. The one or more tab connection ribs 130 may be integrally formed, or molded, with the inner shell 120.

The inner shell 120 illustrated in FIGS. 4 and 5 also includes optional protuberances 128 in the inner shell 120 which protrude outward from the inner shell 120 on opposite sides of the inner shell 160 and in line with an approximate center of the release tabs 200. Tab connections 130 extend from the inner shell outer surface 122 at the protuberances 128 towards the release tabs 200. A tab connection key 135 is formed in or on a portion of the tab connections 130.

A release tab 200 according to various embodiments of the invention includes an exterior tab surface 202, an interior tab surface 204 and a hinge or living hinge 206 connection between the release tab 200 and another part of the aerosol cap 110. As illustrated in FIG. 4, a living hinge 206 connects a release tab 200 to the top deck 114 of the aerosol cap 110. A release tab 200 also includes a tab connector 230 extending from the interior tab surface 204 towards the inner shell 120. A tab lock 235 may be included as part of the tab connector 230 or attached to a tab connector 230. Preferably, a tab lock 235 is configured to mate with and secure a tab connection key 135 on a tab connection rib 130 when a release tab 200 is pushed towards the inner shell 120 of the aerosol cap 110.

For example, the aerosol cap 110 illustrated in FIGS. 3 through 5 is in a new or non-used state. In the new or non-used state, release tabs 200 are connected to the outer shell 160 by the one or more frangible connections 208. If a user pushes on the release tabs 200 with sufficient force to break the one or more frangible connections 208, the release tabs 200 are then free to move inwardly, hinging about the living hinge 206. As the release tabs 200 are pushed inward, the tab lock 235 engages the tab connection key 135, securing or locking the release tab 200 to the inner shell 120. Continued force application on the release tabs 200 transfers force to the inner shell 120, deforming the wall of the inner shell 120 and disengaging the one or more connection ribs 124 from engagement with a portion of an aerosol product 100, allowing the detachment of the aerosol cap 110 from the rest of the aerosol product 100.

According to certain embodiments of the invention, when a release tab 200 is freed from the one or more frangible connections 208, the release tab 200 is free to move. This movement provides a visual indication that the aerosol cap 110 has been tampered with or could possibly have been removed from the aerosol product 100 at some point. In addition, once the one or more frangible connection 208 are broken and a release tab 200 is pushed inward, the tab lock 235 may interact with the tab connection key 135. In some embodiments, such interaction connects a release tab 200 to the inner shell 120 such that the release tab 200 does not move back to the position it was in prior to such movement. The engagement between the tab lock 235 and the tab connection key 135 holds the release tab 200 inward, providing an additional visual cue that the aerosol cap 110 and aerosol product 100 have been tampered with or used. This connection also allows the transfer of force applied to a release tab 200 to the inner shell 120 of the aerosol cap 110.

Figure 6:
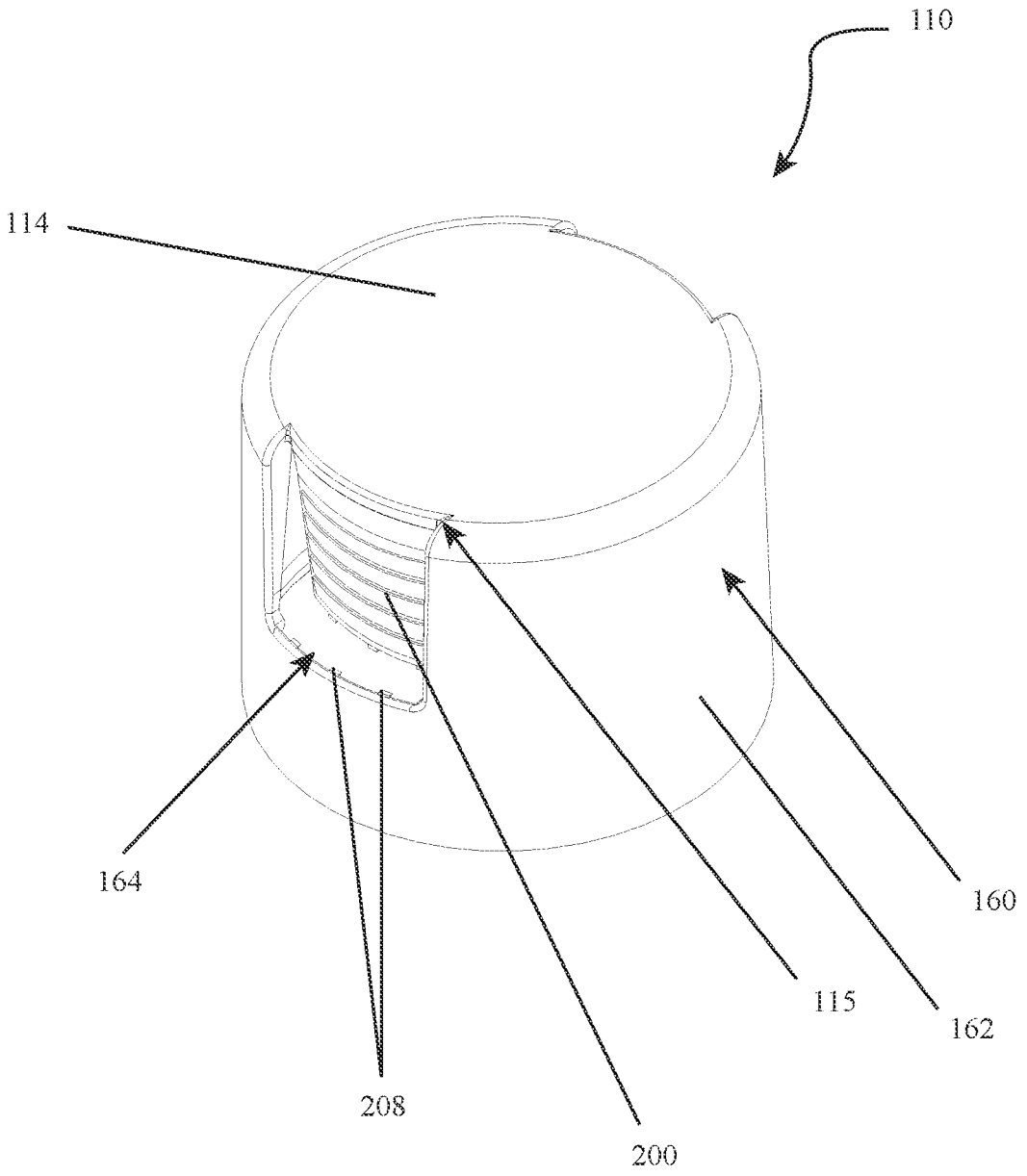
FIG. 6 illustrates a perspective view of the outside of an aerosol cap according to various embodiments of the invention.
Figure 7:
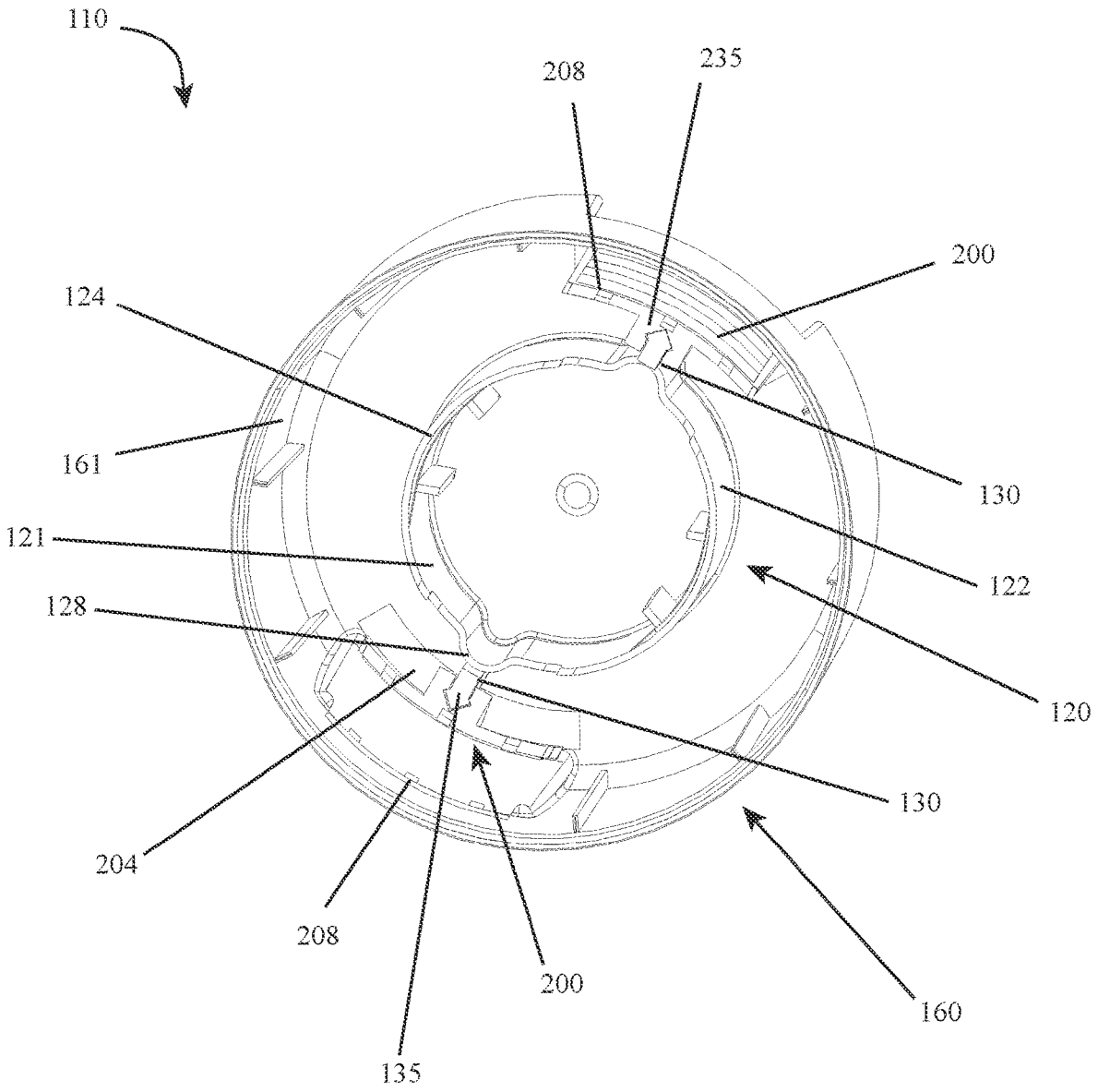
FIG. 7 illustrates a perspective view of an interior of an aerosol cap according to various embodiments of the invention.

An example of an aerosol cap 110 in such used state is illustrated in FIGS. 6 and 7. An exterior view of the aerosol cap 110 is illustrated in FIG. 6 and an interior view of one embodiment of an aerosol cap 110 configuration is illustrated in FIG. 7.

As illustrated in FIG. 6, a release tab 200 has been disengaged from the one or more frangible connections 208, allowing at least a portion of the release tab 200 to move relative to the outer shell 160. As illustrated in FIG. 6, a lower portion of the release tab 200 is pushed inward from the outer shell 160. The extended gap in the outer shell 160, or the increased size of opening 164, between the outer shell 160 and the release tab 200, provides a clear visual indication that the aerosol cap 110 has been tampered with or removed from the aerosol product 100 at some time. In addition, even if the release tab 200 has not been moved enough to lock it in the position shown in FIG. 6, the presence of broken frangible connections 208 provides a visual indication that the aerosol cap 110 has been tampered with or that the release tabs 200 have been compromised.

As illustrated in FIG. 7, when a force is applied to release tabs 200, the tab lock 235 engages with the tab connection key 135 such that the interaction locks or secures the release tab 200 in a connection with the inner shell 120. Such connection between the release tab 200 and the inner shell 120 may be made through the tab connection key 135 which may be connected to a protuberance 128 of the inner shell 120, or a tab connection rib 130 of the inner shell 120, or the inner shell 120 itself. As illustrated in FIG. 7, an inner shell 120 may include a protuberance 128 having a tab connection rib 130 with a tab connection key 135 formed as part of the tab connection rib 130 or extending from the tab connection rib 130. A tab lock 235 extending off a back portion or interior tab surface 204 of a release tab 200 may connect with the tab connection key 135.

When one or more release tabs 200 have been disengaged from the outer shell 160 and squeezed inward therefrom, the release tabs 200 may engage the inner shell 120 or be connected to the inner shell 120 through a tab lock 235 and tab connection key 135. In such position, the aerosol cap 110 may be removed from an aerosol product 100 by applying pressure to the release tabs 200 such that the inner shell 120 flexes and allows the aerosol cap 110 to disengage from an aerosol product 100. Flexing of the inner shell 120 allows the one or more connection ribs 124 to disengage from contact with portions of the aerosol product 100 which are retaining the aerosol cap 110 thereon.

Following removal of an aerosol cap 110 from an aerosol product 100, the aerosol cap 110 may be snapped back onto an aerosol product 100 by applying a force to the aerosol cap 110 and pushing it onto an aerosol product 100 such that the inner shell 120 flexes and allows the inner shell 120 to attach to a portion of the aerosol product 100. For example, application of a force upon an aerosol cap 110 as it is being seated back on an aerosol product 100 may flex the inner shell 120, allowing the one or more connection ribs 124 to attach to a chime of the aerosol product 100 or other portion of the aerosol product 100. When reattached to an aerosol product 100, the opening 164 in the outer shell 160 of the aerosol cap 110 between the outer shell 160 and the one or more release tabs 200 will be larger if the release tabs 200 have been secured to the inner shell 120. This larger opening 164—as well as any broken frangible connections 208 if used with such embodiment-visually demonstrate that the aerosol cap 110 may have been removed from the aerosol product 100 or that the aerosol cap 110 has at least been tampered with.

While the embodiments of the invention illustrated in FIGS. 3 through 7 include tab connection keys 135 having an arrow or pointed shape, it is understood that the shape of the tab connection keys 135 is not limited. Further, the shape of a tab lock 235 may be any shape and preferably a shape that will accept and hold a tab connection key 135 mating with the tab lock 235. For example, a tab lock 235 may be rounded in shape and a tab connection key 135 may have a round shape that generally mirrors the tab lock 235 shape and that can be inserted into the tab lock 235 and retained therein. Other shapes may also be used and may not be similar. For example, an arrow headed tab connection key 135 may fit into an be retained by a round or oval shaped tab lock 235. Embodiments of the invention are not limited by the shape of the tab locks 235 and tab connection keys 135.

Figure 8:
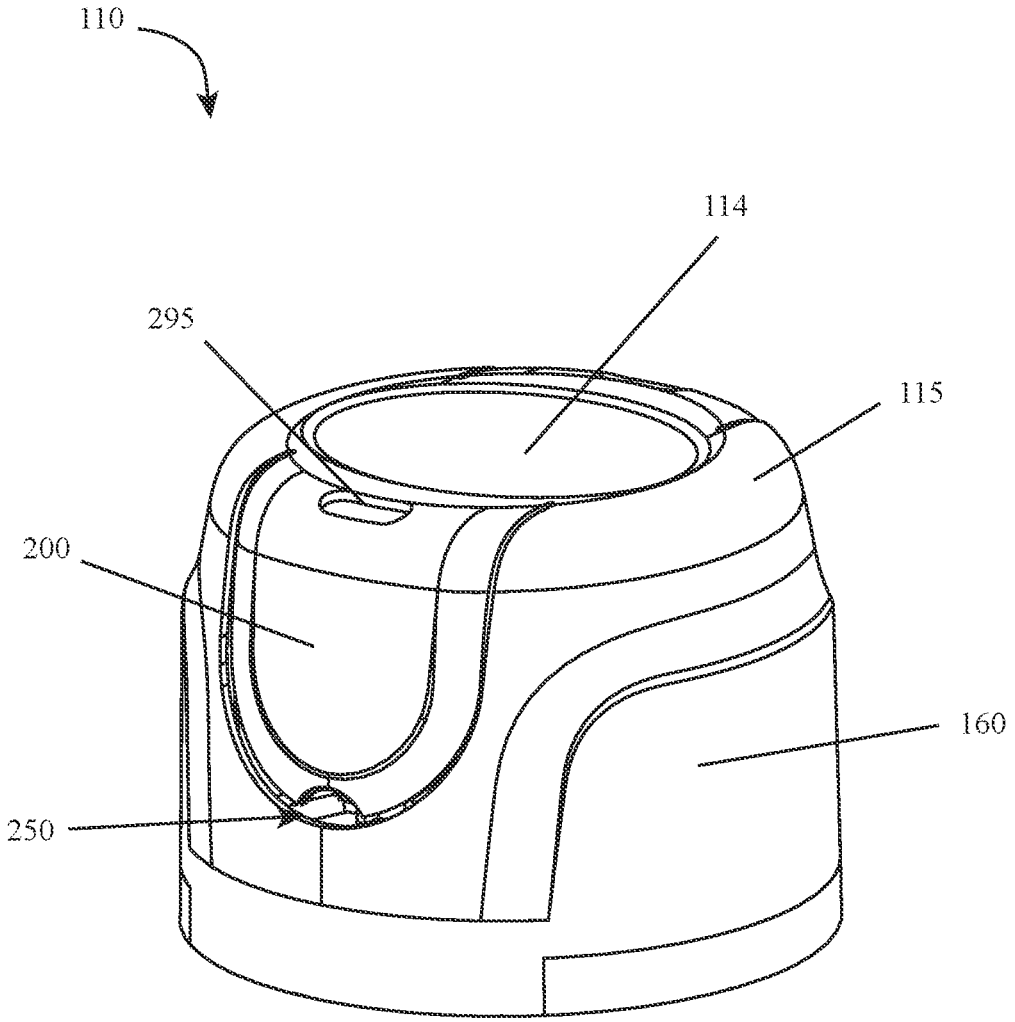
FIG. 8 illustrates a perspective view of the outside of an aerosol cap according to various embodiments of the invention.
Figure 9:
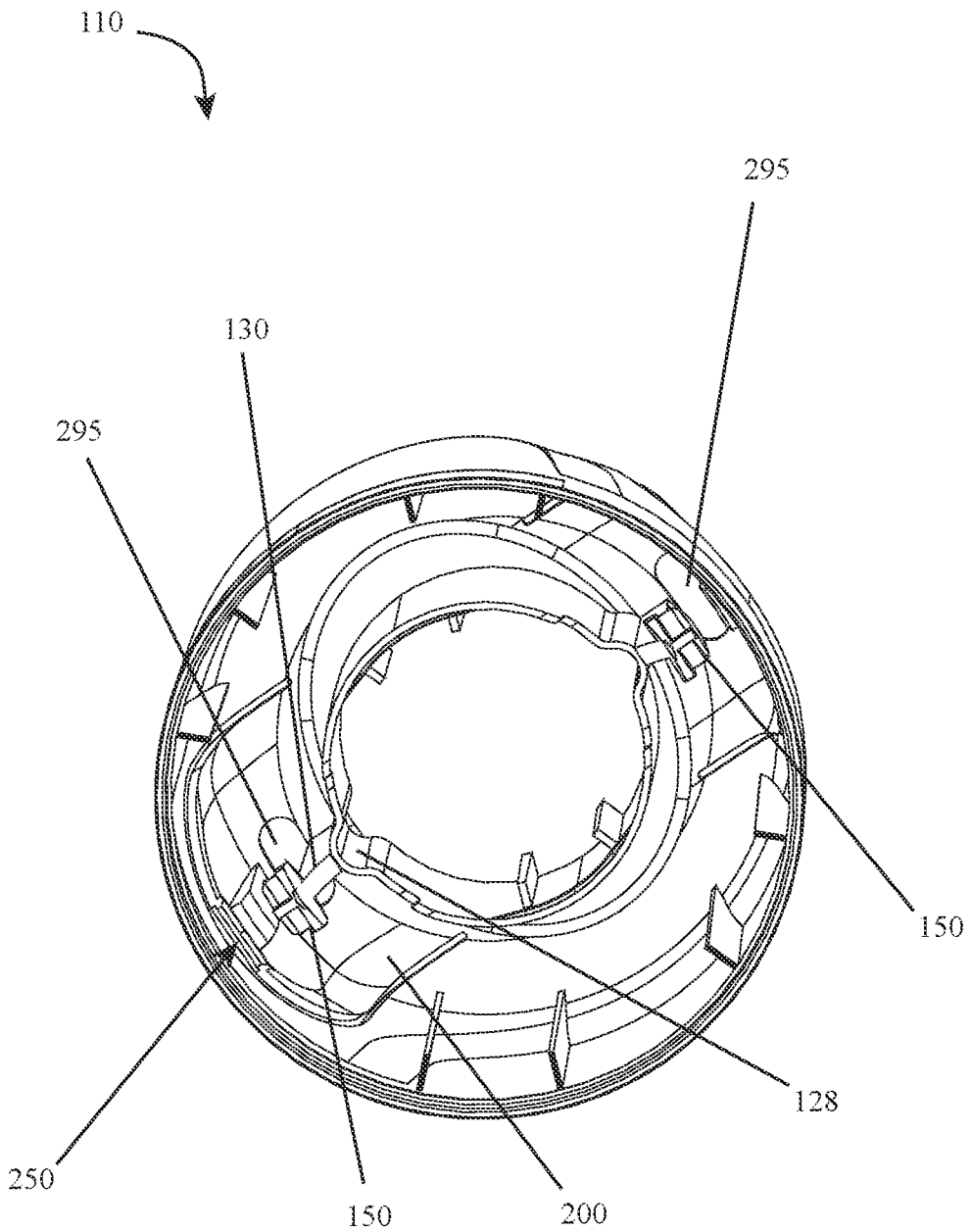
FIG. 9 illustrates an interior view of the aerosol cap illustrated in FIG. 8.
Figure 10:
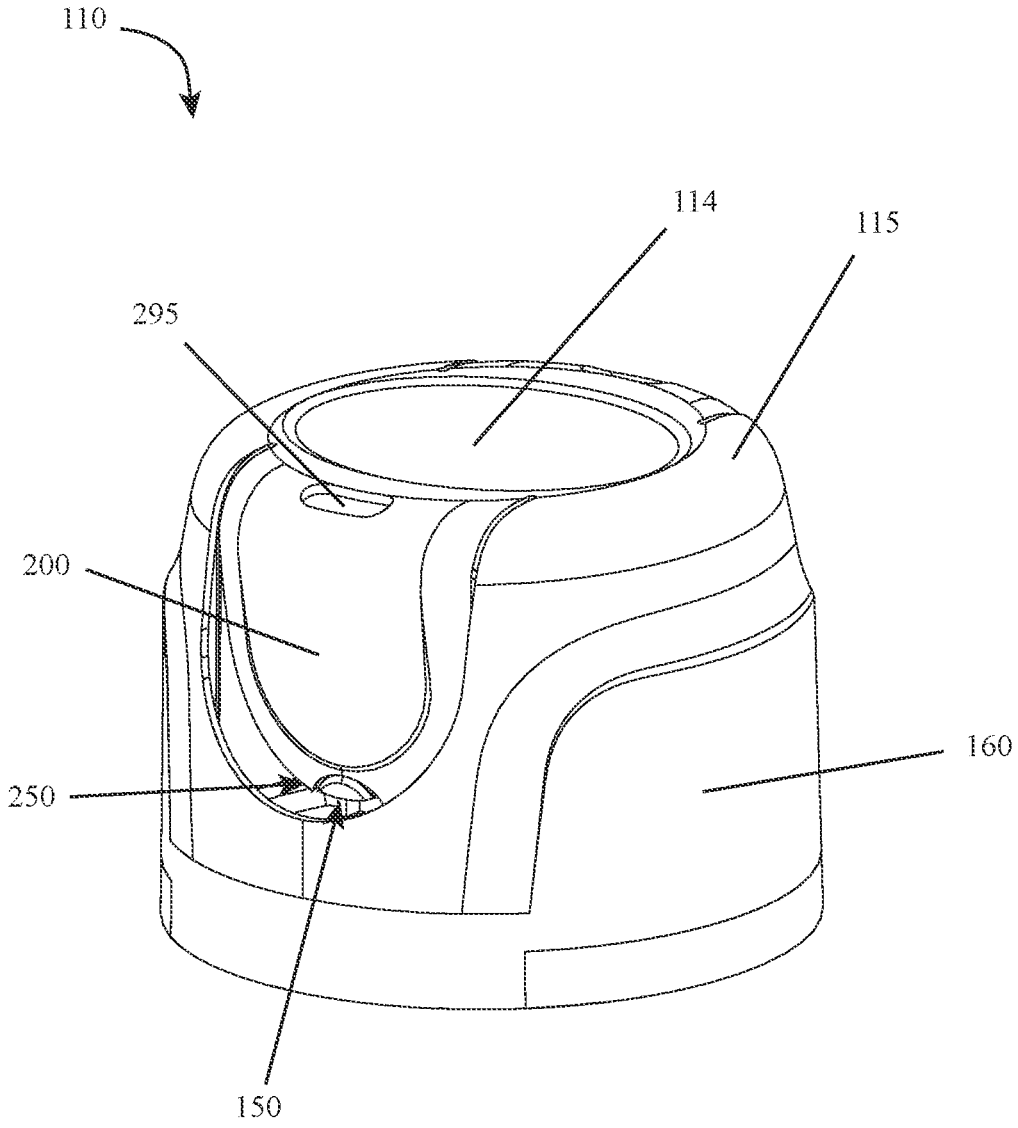
FIG. 10 illustrates a perspective view of the outside of the aerosol cap illustrated in FIG. 8 following movement of a release tab.

An aerosol cap 110 according to other embodiments of the invention is illustrated in FIGS. 8 through 10. As illustrated in those Figures, instead of a tab lock 235 and tab connection key 135 fitment, the aerosol cap 110 may include a tab clip 150 and a tab clip connection 250 which may interact to retain the release tab 200 in a position relative to the tab clip 150 after initial operation or movement of the release tab 200. Other features and structures of the aerosol cap 110 illustrated in FIGS. 3 through 7 may be included in the aerosol cap 110 embodiments illustrated in FIGS. 8 through 10.

As illustrated in FIG. 8, an aerosol cap 110 according to certain embodiments of the invention includes a top deck 114 and an outer edge 115. While the outer edge 115 of the aerosol cap 110 illustrated in FIG. 8 is rounded, it is understood that the outer edge 115 could also be of other shapes or include a sharp angle; it does not need to be rounded. An outer shell 160 extends away from the top deck 114. A release tab 200 is formed in a portion of the outer shell 160 and may include a living hinge 206 formed in the outer shell 160, the outer edge 115, or the top deck 114 of the aerosol cap 110. The release tab 200 includes a tab clip connection 250 portion. As illustrated in FIG. 8, a tab clip connection 250 portion may be located at a bottom portion of the release tab 200. In other embodiments, a tab clip connection 250 portion may be located along other portions of the release tab 200 edges.

One or more molding openings 295 may also be present in the release tab 200, in the top deck 114, or in the outer edge 115. As illustrated in FIGS. 8, a molding opening 295 is positioned as part of the release tab 200 on the outer edge 115. The molding opening 295 is configured to allow the movement of a slide or mold portion through the top deck 114, outer edge 115, or release tab 200 to facilitate the formation of interior structures of the aerosol cap 110.

An underside view of the aerosol cap 110 shown in FIG. 8 is illustrated in FIG. 9. The aerosol cap 110 includes an inner shell 120 having at least one protuberance 128 and a tab connection rib 130 extending away from the protuberance 128 towards the outer shell 160. A tab clip 150 is formed on an outer edge of the tab connection tib 130. A tab clip 150 may be configured to engage a tab clip connection 250 of a release tab 200 when a portion of a release tab 200 is pushed inwardly into an interior of the aerosol cap 110. The tab clip 150 may flex such that a portion of the release tab 250 may engage the tab clip 150 causing it to flex downward or in a direction to allow the release tab 200 to continue moving inwardly.

Figure 11:
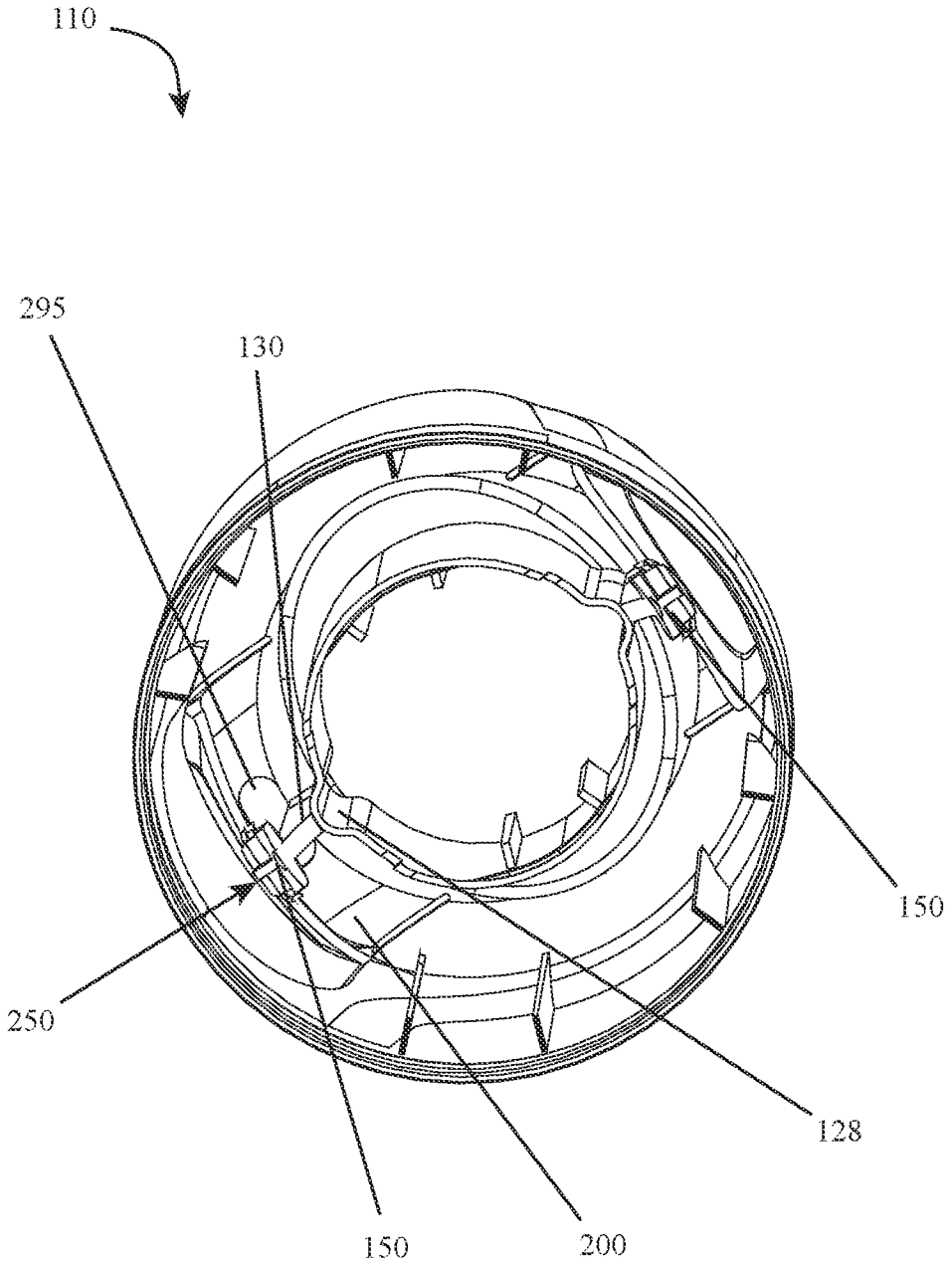
FIG. 11 illustrates an interior view of the aerosol cap illustrated in FIG. 10.

For example, the aerosol cap 110 illustrated in FIGS. 8 and 9 is illustrated in FIGS. 10 and 11 in a position in which the release tab 200 has been at least partially separated from the outer shell 160 and pushed inward. As the tab clip connection 250 of the release tab 200 passes over the tab clip 150, the tab clip 150 may flex back into its original position, engaging the tab clip connection 250 and locking it or preventing it from returning to its original position. The engagement of the tab clip 150 with the tab clip connection 250 retains the release tab 200 in a position inward of the beginning position, making it visually obvious that the release tab 200 has been tampered with or engaged to remove the aerosol cap 110 from the aerosol product 100 to which it is attached. The view of the aerosol cap 110 in an actuated position—or in a position in which the release tab 200 has been engaged by the tab clip 150 to lock the release tab 200 in an open position—is illustrated in FIGS. 10 and 11. As illustrated, the tab clip 150 engages the tab clip connection 250 portion of the release tab 200 to hold the release tab 200 in a position inward of the outer shell 160.

As illustrated in FIGS. 8 through 11, one or more molding openings through a surface of the aerosol cap 110 allows the formation of a tab clip 150 on an interior of the aerosol cap 110. One of the issues with forming a tab clip 150 capable of engaging with a tab clip connection 250 portion of a release tab 200 is the requirement to have an engaging lip or wing that extends off of the tab clip 150 and which can engage and hold the release tab 200 after it interacts with the tab clip 150. The presence of one or more molding openings 295 allows a slide or other portion of a mold used to mold the aerosol cap 110 to project through a molding opening 295 and facilitate the formation of a tab clip 150 having the necessary shape to retain a release tab 200 that is engaged with the tab clip 150.

While various embodiments of the invention are illustrated with release tabs 200 connected to the top deck 114 or an outer edge 115 thereof, it is understood that a release tab 200 according to embodiments of the invention may also be formed in the wall of the outer shell 160. For example, an opening 164 in the outer shell 160 may be encircled or surrounded by portions of the outer shell 160 such that the release tab 200 is formed as a part of the outer shell 160. A gap or opening in the outer shell 160 thereby defines a release tab 200. That portion of the release tab 200 that remains connected to the outer shell 160 acts as a living hinge 206 for the release tab 200. As with other embodiments, one or more frangible connections 208 may be included to indicate if the release tab 200 has been actuated or separated from the outer shell 160. In other embodiments, the aerosol cap 110 may not include one or more frangible connections 208, having just a gap. In those embodiments where no frangible connections 208 are used, visual indication of actuation or potential tampering with the aerosol cap 110 may be ascertained by the locking of the release tab 200 in the actuation position caused by the interaction of the tab lock 235 with a tab connection key 135. In addition, in some embodiments, movement of the release tab 200 may create a color differentiation along the living hinge 206 such that evidence that the release tab 200 has been flexed relative to the outer shell 160 is visually apparent.

According to various embodiments of the invention, an aerosol cap 110 may be molded in a single molding process, wherein an aerosol cap 110 such as that illustrated in FIGS. 3 through 5 or 7 and 8 is formed. The molded aerosol cap 110 may be included on an aerosol filling line or an aerosol product production assembly line where the aerosol cap 110 may be attached to other components to form an aerosol product 100. For example, the aerosol caps 110 illustrated in the Figures include two connection ribs 124 extending off of the inner shell inner surface 121 towards the center of the aerosol cap 110. The two connection ribs 124 are opposite each other on the inner shell 120 and generally have a center point about ninety degrees from the protuberance 128 center points.

To assemble the aerosol cap 110 to other components of an aerosol product 100, the aerosol cap is aligned to the top of the aerosol product 100 and then pushed onto the aerosol product 100 components. The aerosol cap 110 may snap onto the chime of an aerosol valve 910 where it connects to an aerosol container 900. When engaged with the chime, the inner shell 120 flexes, allowing the connection ribs 124 to pass over the chime and snap around the chime, securing the aerosol cap 110 to the chime. To remove the aerosol cap 110, the inner shell 120 must be flexed to release the retention that the connection ribs 124 have on the chime. This is accomplished by applying a force at the protuberances 128 to flex the inner shell 120 and move the position of the connection ribs 124. To apply such force using aerosol caps 110 according to embodiments of the invention, a user must first press on the release tabs 200 to break any frangible connections 208 to allow movement of the release tabs 200 towards the inner shell 120. Upon sufficient movement of the release tabs 200, the tab locks 235 engage the tab connection keys 135 associated with the inner shell 120 or the tab clip connection 250 interacts with the tab clip 150. Continued application of force on the release tabs 200 applies a force to the protuberances 128 which in turn generates flexing in the inner shell 120 and a changing of shape of the inner shell 120. The flexing of the inner shell 120 moves the connection ribs 124 such that they disengage from the chime of the aerosol product 100 and allow the aerosol cap 110 to be removed from the aerosol product 100 so that a user may dispense the aerosol formula contained in the aerosol container 900.

To reattach an aerosol cap 110, a user may push the aerosol cap 110 back onto the chime of the aerosol product 100. This can be accomplished by aligning the aerosol cap 110 over the aerosol product 100 and pushing downward on the aerosol cap 110. For instance, a force applied to the top deck 114 of the aerosol cap 110, the outer shell 160 of the aerosol cap 110, or both may be sufficient to force the inner shell 120 to flex and allow the connection ribs 124 to move past and then catch the chime of the aerosol product 100. Once reattached to the aerosol product 100, the release tabs 200 are retained in the inward position by the interaction of the tab lock 235 with the tab connection key 135 or the tab clip connection 250 with the tab clip 150. To remove the aerosol cap 110 from the aerosol product 100 again, a user need only press on the release tabs 200 and apply a necessary force to flex the inner shell 120 to allow the aerosol cap 110 to be released.

While various embodiments of the invention include release tabs 200 having a tab lock 235 and tab connection keys 135 or tab clip connections 250 and tab clips 150, other embodiments of the invention may not include such features. Instead, the inner shell 120 may only include a tab connection rib 130 extending outwardly from a protuberance 128 or from the inner shell 120 itself. When a force is applied to a release tab 200, the release tab 200 moves about the living hinge 206 inward of the outer shell 160 until it engages with the connection rib 130. Force applied to the release tab 200 is transferred to the connection rib 130, in turn, flexing the inner shell 120 such that the aerosol cap 110 may be released from an aerosol product 100. In such embodiments, the release tab 200 is not retained against the tab connection rib 130 and may return—at least partially—to the position it was in prior to use.

In other embodiments, an inner shell 120 may not include a protuberance 128, a tab connection rib 130, or both such features. Instead, a release tab 200 may interact directly with the inner shell outer surface 122 to flex the inner shell 120. Alternatively, a projection or rib may be included on a back side of a release tab 200 such that the projection or rib may interact with the inner shell 120 when the release tab 200 is pressed inward.

In still other embodiments, the inner shell 120 may not include a tab connection rib 130 or a tab connection key 135 or tab clip 150. Instead, release tab 200 may interact directly with the inner shell 120 or a protuberance 128 extending off the inner shell 120. In such instances, the interior tab surface 204 of the release tab 200 may create the interaction. In other embodiments, release tab 200 may include a tab connector 230 or other feature extending from the interior tab surface 204 and that feature may engage the inner shell 120 or a protuberance 128 on the inner shell 120. Such engagement may be sufficient to deform or flex the inner shell 120 such that the aerosol cap 110 may be removed from an aerosol product 100.

An aerosol container 900 is illustrated in FIG. 1 as part of the aerosol product 100. According to various embodiments of the invention, an aerosol container 900 may be made of a material selected from metal, plastic, resin, or other material. For instance, traditional one-piece or two-piece containers typically used with aerosol products may be used as an aerosol container 900 according to embodiments of the invention. In other embodiments, an aerosol container 900 may be a plastic container used with aerosol products or configured to contain an aerosol formulation.

Embodiments of the invention may be fitted with any type of dispensing feature 950 desired. While FIG. 2 illustrates the use of a conventional pushbutton having a fluid flow path and an orifice-which may or may not include an orifice cup—other dispensing features 950 may also be used. For example, a trigger actuator may be used as a dispensing feature 950 or a spray through actuator could be configured to be used as a dispensing feature 950. Embodiments of the invention are not limited by the type of dispensing feature 950 utilized with the aerosol product 100.

While various embodiments of the invention are disclosed relative to use with aerosol products 100 and aerosol dispensing systems, embodiments of the invention may be incorporated with other products. For instance, any container employing the use of a cap may utilize a cap having features associated with the aerosol caps 110 of the present invention. As an example, a fine-mist product-such as a hair-care product—may include a container, a fine-mist pump attached to the container, and a cap. The cap may incorporate all or certain features of the aerosol cap 110 such that the cap used with the fine-mist sprayer may also indicate tampering or use of a product therein.

In other examples, a cap incorporating the tamper evident features of the aerosol cap 110 according to various embodiments of the invention may be advantageous in the health-care industry where prescription or over-the-counter products need to include tamper-evident features to indicate when a product has been used or compromised. For instance, an eye-dropper system configured to dispense an ophthalmic medication may include a cap having release tabs in an outer shell that can be disengaged from the outer shell and connected to an inner shell or other feature of the cap such that the release tabs are capable of indicating when a cap has been removed from the system or when the product may have been tampered with.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. An aerosol cap, comprising:
a top deck comprising an outer edge;
an outer shell extending from the outer edge, comprising:
a first opening; and
a second opening;
a first hinged release tab extending off the top deck into the first opening, comprising:
at least one first frangible connection connecting the first release tab to the outer shell;
a second hinged release tab extending off the top deck into the second opening, comprising:
at least one second frangible connection connecting the second release tab to the outer shell;
an inner shell extending from the top deck interior of the outer shell;
a first tab connection key extending from the inner shell towards the first release tab;
a first tab lock on the first release tab;
a second tab connection key extending from the inner shell towards the second release tab; and
a second tab lock on the second release tab,
wherein the first tab lock engages and is retained on the first tab connection key when a force sufficient to break the at least one first frangible connection is applied to the first release tab and the second tab lock engages and is retained on the second tab connection key when a force sufficient to break the at least one second frangible connection is applied to the second release tab.

2. The aerosol cap of claim 1, wherein the first tab connection key and the second tab connection key have an arrow shape.

3. The aerosol cap of claim 2, wherein the first tab lock and the second tab lock are shaped to engage the first tab connection key and the second tab connection key respectively.

4. The aerosol cap of claim 1, wherein at least a portion of the first release tab is recessed in the first opening and at least a portion of the second release tab is recessed in the second opening.

5. An aerosol product, comprising:
an aerosol container;
an aerosol valve attached to the aerosol container;
a dispensing feature attached to the aerosol valve; and
a removeable aerosol cap, comprising:
a top deck;
an outer shell extending away from the top deck;
an inner shell extending away from the top deck interior of the outer shell;
at least one connection rib on the inner shell; and
a release tab
a tab connection key extending from the inner shell towards the release tab;
a tab lock on the release tab,
wherein the tab lock is retained on the tab connection key when the release tab is actuated inwardly.

6. The aerosol product of claim 5, wherein the release tab comprises a first release tab and a second release tab on opposing sides of the removable aerosol cap.

7. The aerosol product of claim 6, further comprising:
a first living hinge connecting the first release tab to the outer shell; and
a second living hinge connecting the second release tab to the outer shell.

8. The aerosol product of claim 6, further comprising:
a first living hinge connecting the first release tab to the top deck; and
a second living hinge connecting the second release tab to the top deck.

9. The aerosol product of claim 6, wherein the tab connection key comprises a first tab connection key extending from the inner shell towards the first release tab, and a second tab connection key extending from the inner shell towards the second release tab, wherein the tab lock comprises a first tab lock on the first release tab and a second tab lock on the second release tab, and wherein the first and second tab locks are retained on the first and second tab connection keys when the first and second release tabs are actuated inwardly.

10. The aerosol product of claim 5, wherein the at least one connection rib interacts with the aerosol container to retain the aerosol cap on the aerosol product.

11. The aerosol product of claim 5, further comprising a chime wherein the at least one connection rib interacts with the chime to retain the aerosol cap on the aerosol product.

* * * * *